US009417003B2

(12) United States Patent
Baack

(10) Patent No.: US 9,417,003 B2
(45) Date of Patent: Aug. 16, 2016

(54) SINGLE INFRARED EMITTER VESSEL DETECTOR

(71) Applicant: Electrolux Home Products, Inc., Charlotte, NC (US)

(72) Inventor: Jerry Baack, Anderson, SC (US)

( * ) Notice: Subject to any disclaimer, the term of this patent is extended or adjusted under 35 U.S.C. 154(b) by 542 days.

(21) Appl. No.: 13/827,551

(22) Filed: Mar. 14, 2013

(65) Prior Publication Data

US 2014/0261879 A1 Sep. 18, 2014

(51) Int. Cl.
*F25C 5/00* (2006.01)
*F25D 23/12* (2006.01)

(52) U.S. Cl.
CPC ..... *F25C 5/005* (2013.01); *F25D 23/126* (2013.01); *F25D 2700/06* (2013.01)

(58) Field of Classification Search
CPC ..... G01S 17/06; G01S 17/08; G01S 17/10; G01S 17/026; G01S 17/32; G01S 17/42; G01S 17/46; G01S 17/48; F25C 5/005; F25D 23/126; F25D 2700/06; G01V 8/10; G01V 8/20; G08B 13/183; B67D 2001/009; B67D 1/124; B67D 1/1236; B67D 1/1238
USPC ..... 141/94, 95, 198
See application file for complete search history.

(56) References Cited

U.S. PATENT DOCUMENTS 3,967,111 A * 6/1976 Brown ..... G01S 17/10 250/206
4,202,387 A * 5/1980 Upton ..... B65B 3/36 141/360
5,139,339 A * 8/1992 Courtney ..... B41J 11/009 250/341.8
5,168,163 A * 12/1992 Francioni ..... G01V 8/20 209/524
5,245,177 A * 9/1993 Schiller ..... G01V 8/20 250/221
5,862,844 A 1/1999 Perrin
5,902,998 A * 5/1999 Olson ..... G01S 17/026 235/462.23
7,028,725 B2 4/2006 Hooker
7,673,661 B2 3/2010 Chase et al.

(Continued)

FOREIGN PATENT DOCUMENTS

WO 99/50172 A1 10/1999

OTHER PUBLICATIONS

International Search Report and Written Opinion issued in Application No. PCT/US2014/023101 dated Oct. 9, 2014.

(Continued)

*Primary Examiner* — Mark A Laurenzi
*Assistant Examiner* — Andrew Stclair
(74) *Attorney, Agent, or Firm* — Pearne & Gordon LLP

(57) ABSTRACT

Provided is a single infrared emitter dispenser monitor for refrigeration appliance that includes a dispenser that dispenses at least one of water and ice. A vessel detector includes an infrared emitter, a first infrared detector, and a second infrared detector. The infrared emitter emits radiation having an angle of dispersion such that both of the first and second infrared detectors receive the radiation emitted by the infrared emitter. The first infrared detector is arranged more frontward than the second infrared detector. In further examples, an elapsed time between detection signals is compared to a minimum elapsed time, and a dispensing signal is only sent if the elapsed time is greater than the minimum elapsed time. By this configuration, the number of input/output lines running into a control device is reduced, and it is possible to detect a failed emitter if both detector signals fall to zero at the same time.

10 Claims, 5 Drawing Sheets

(56) References Cited

U.S. PATENT DOCUMENTS

| | | | | |
|---|---|---|---|---|
| 7,677,053 | B2 | 3/2010 | Truitt | |
| 7,690,403 | B2 | 4/2010 | You et al. | |
| 8,151,596 | B2 * | 4/2012 | Richmond | G01F 11/284 62/389 |
| 2001/0050116 | A1 | 12/2001 | Skell | |
| 2005/0138951 | A1 | 6/2005 | Hooker | |
| 2007/0009365 | A1 * | 1/2007 | Litterst | B67D 1/102 417/44.1 |
| 2008/0105331 | A1 * | 5/2008 | You | B67D 1/0871 141/198 |
| 2008/0264092 | A1 * | 10/2008 | Chase | B67D 1/0858 62/389 |
| 2009/0013708 | A1 | 1/2009 | Truitt | |
| 2009/0293733 | A1 | 12/2009 | Martin et al. | |
| 2011/0061766 | A1 * | 3/2011 | Beier | F25D 23/126 141/192 |
| 2012/0138629 | A1 | 6/2012 | Ashrafzadeh | |
| 2012/0253739 | A1 * | 10/2012 | Konishi | G01V 8/20 702/150 |
| 2013/0141710 | A1 * | 6/2013 | Hayden | G01V 8/20 356/5.01 |
| 2013/0278423 | A1 * | 10/2013 | Chen | G01V 8/20 340/556 |
| 2014/0028436 | A1 * | 1/2014 | Osako | G01V 8/20 340/3.2 |

OTHER PUBLICATIONS

Partial Internatinal Search Report issued in Applicaiton No. PCT/US2014/023101 dated Jun. 2, 2014.

* cited by examiner

SINGLE INFRARED EMITTER VESSEL DETECTOR

BACKGROUND OF THE INVENTION

1. Field of the Invention

The present disclosure relates generally to a single infrared emitter vessel detector, and more particularly, to a single infrared emitter vessel detector for a refrigeration appliance having a dispenser that dispenses at least one of water and ice.

2. Description of Related Art

Refrigeration appliances having a cabinet with a recess and dispenser for dispensing at least one of water and ice are well known in the art. It is also well known to align and pair a single infrared (IR) light emitting diode (LED) emitter with a single IR detector across the opening of a recess for detecting the presence of a vessel such as a drinking cup.

U.S. Pat. No. 7,677,053 discloses a detection system having a single IR LED emitter and detector aligned and paired with each other across the opening of a recess. U.S. Pat. No. 7,673,661 discloses a detection system that employs an array of multiple IR emitters and detectors aligned and paired across the opening of a recess. U.S. Pat. No. 7,028,725 discloses a detection system having aligned and paired IR LED emitters and detectors, where the emitter/detector pairs are arranged such that radiation from the emitters intersects at a point in the opening of the recess.

As is common with IR detection systems, detecting elements may fail over time. Therefore, most detecting systems using an IR emitter/detector pair for detection employ multiple emitter/detector pairs to keep the control device from accidentally dispensing liquid or ice on the failure of one of the detecting elements. However, this requires several input/output lines into the control device. Additionally, designs with an increased number of detection elements require more power. This is especially true for designs using multiple emitters, because the majority of the power in the detection circuitry is used to power the emitting elements.

BRIEF SUMMARY OF THE INVENTION

In accordance with one aspect of the present invention, provided is a refrigeration appliance having a cabinet forming an enclosure, a dispenser that dispenses at least one of water and ice to an exterior of the enclosure and a vessel detector. The vessel detector includes an infrared emitter, a first infrared detector, and a second infrared detector. The infrared emitter emits radiation having an angle of dispersion, and both of the first and second infrared detectors receive the radiation emitted by the infrared emitter. The first infrared detector is arranged closer to a front surface of the cabinet than the second infrared detector.

In accordance with another aspect of the present invention, provided is a refrigeration appliance having a cabinet forming an enclosure, a dispenser that dispenses at least one of water and ice to an exterior of the enclosure, a vessel detector and a control unit. The vessel detector includes an infrared emitter, a first infrared detector, and a second infrared detector. The infrared emitter emits radiation having an angle of dispersion, and both of the first and second infrared detectors receive the radiation emitted by the infrared emitter. The control unit stores a minimum elapsed time, detects a first reduction in a first level of radiation detected by the first infrared detector and a second reduction in a second level of radiation detected by the second infrared detector, determines an elapsed time between the first reduction and the second reduction, and sends a dispense signal to the dispenser based on the elapsed time being greater than the minimum elapsed time.

In accordance with another aspect of the present invention, provided is a method of controlling a dispenser in a refrigeration appliance having a dispenser that selectively dispenses at least one of water and ice. The method includes the steps of emitting radiation having an angle of dispersion from an infrared emitter, detecting a first level of radiation from the infrared emitter using a first infrared detector arranged within a detectable area of the radiation, detecting a second level of radiation from the infrared emitter using a second infrared detector arranged within the detectable area of the radiation, determining a first reduction in the level of radiation detected by the first detector, determining a second reduction in the level of radiation detected by the second detector, determining an elapsed time between the first reduction and the second reduction, comparing the elapsed time to a minimum elapsed time and dispensing at least one of water and ice from the dispenser only if the elapsed time is greater than the minimum elapsed time.

BRIEF DESCRIPTION OF THE DRAWINGS

FIG. 5(*b*) is a wave diagram of an IR detector signal.

FIG. 5(*c*) is a wave diagram of an IR detector signal with ambient light interference.

FIG. 5(*d*) is a wave diagram of an IR detector signal with ambient light interference and a vessel inserted between the emitter and detector.

FIG. 5(*e*) is a wave diagram of an IR detector signal with ambient light interference and an alternative vessel inserted between the emitter and detector.

DETAILED DESCRIPTION OF THE INVENTION

Figure 1:
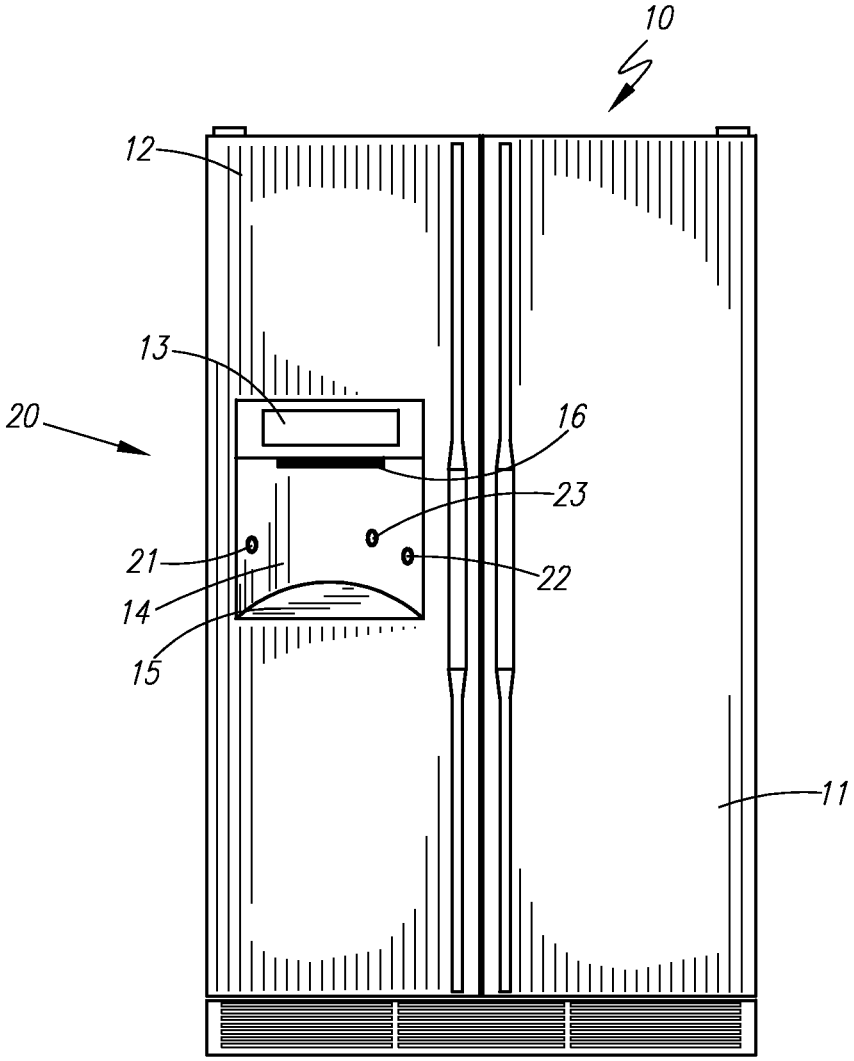
FIG. 1 is a front view of a refrigerator appliance having a recess for dispensing water and/or ice.

The present invention will now be described with reference to the drawings, wherein like reference numerals are used to refer to like elements throughout. It is to be appreciated that the various drawings are not necessarily drawn to scale from one figure to another nor inside a given figure, and in particular that the size of the components are arbitrarily drawn for facilitating the understanding of the drawings. In the following description, for purposes of explanation, numerous specific details are set forth in order to provide a thorough understanding of the present invention. It may be evident, however, that the present invention can be practiced without these specific details. Additionally, other embodiments of the invention are possible and the invention is capable of being practiced and carried out in ways other than as described. The terminology and phraseology used in describing the invention is employed for the purpose of promoting an understanding of the invention and should not be taken as limiting.

Referring to FIG. 1, a refrigeration appliance in the form of a refrigerator 10 for use in the home comprises side-by-side freezer and fresh food cabinets. Alternatively, the refrigerator could be a top mount refrigerator with the freezer above the fresh food cabinet, or a bottom mount refrigerator with the freezer beneath the fresh food cabinet. A door 11 provides a means for gaining access to the fresh food cabinet, and a door 12 provides means for gaining access to the freezer cabinet of the refrigerator 10. Located generally centrally at the surface or exterior of the door 12 is a recess indicated generally at 20. As can be seen, the recess 20 is located in the door 12. The recess has an upright wall 14 and a bottom surface 15. The upright wall 14 and bottom surface 15 are substantially perpendicular to each other. A dispenser 16 for dispensing at least one of water and ice is located in an upper portion of the recess 20. An IR LED 21 is located in the left portion of the upright wall 14 and is exposed to the opening of the recess 20. A first IR detector 22 is located in the right portion of upright wall 14 and is exposed to the opening of recess 20. A second IR detector 23 is also located in the right portion of upright wall 14 and is set further back in the recess 20 as compared to the first IR detector 22. The second IR detector 23 is also exposed to the opening of the recess 20. In one embodiment, the IR LED 21, the first IR detector 22 and the second IR detector 23 are located at substantially the same distance from bottom surface 15. The first and second IR detectors 22, 23 are positioned to receive radiation emitted from IR LED 21. Other locations of the IR LED 21 and the first and second IR detectors 22, 23 are possible. For example, the IR LED 21 could be located in a lower right portion of the upright wall 14 while the first and second IR detectors 22, 23 are located in an upper left portion of the upright portion of upright wall 14.

Figure 2:
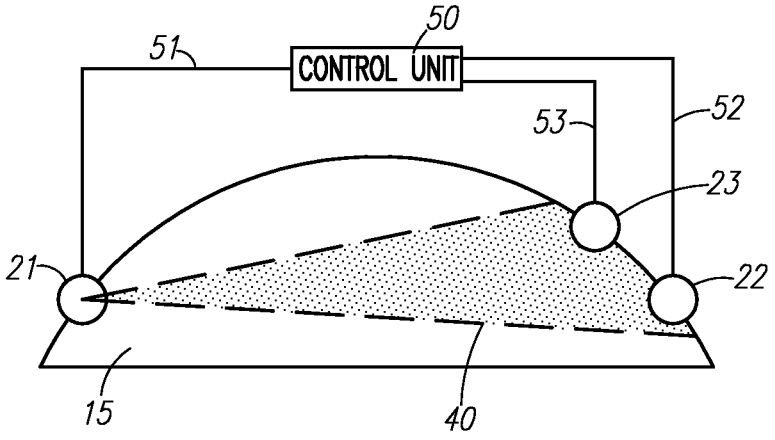
FIG. 2 is a top view of the recess.

Referring now to FIG. 2, a control unit 50 is included for controlling the IR LED 21 via connection 51, and for processing signals from the first IR detector 22 via connection 52 and the second IR detector 23 via connection 53. The IR LED 21 emits radiation 40 across the opening of the recess 20 towards the direction of the first IR detector 22 and the second IR detector 23. The IR LED 21 has an angle of dispersion for the emitted radiation, resulting in a conical area of radiation 40. Both the first IR detector 22 and the second IR detector 23 are arranged within the conical area of radiation 40 to detect the radiation 40.

Figure 3:
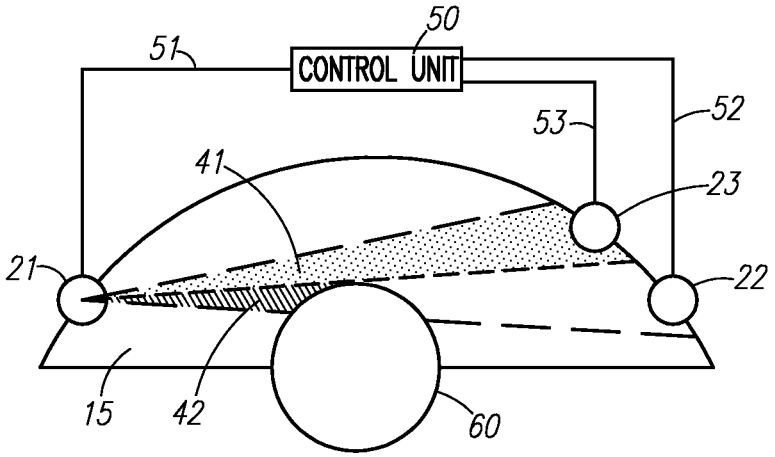
FIG. 3 is a top view of the recess with a vessel partially inserted into the recess.
Figure 4:
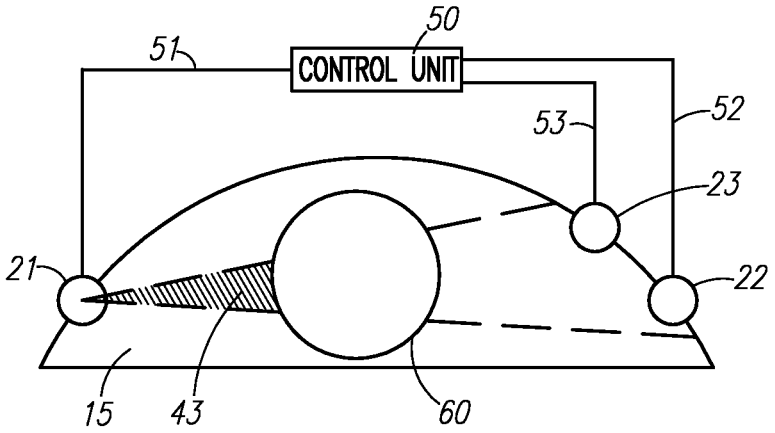
FIG. 4 is a top view of the recess with a vessel fully inserted into the recess.
Figure 5A:
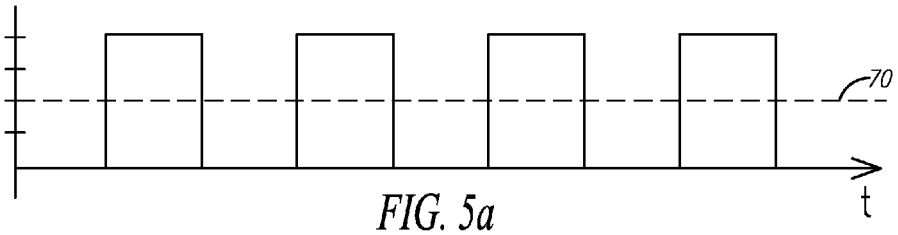
FIG. 5(*a*) is a wave diagram of an IR LED output signal.
Figure 5B:
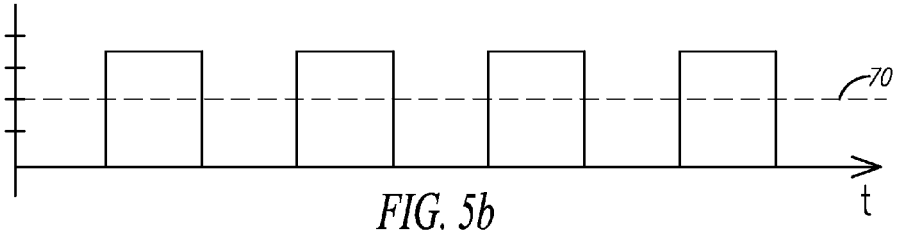
Figure 5C:
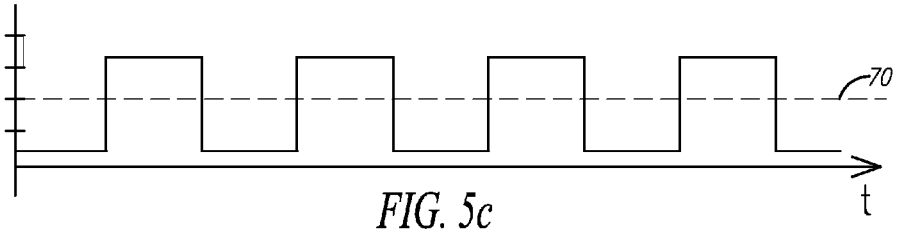
Figure 5D:
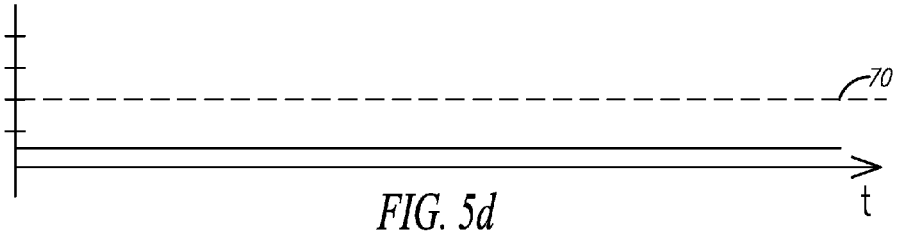
Figure 5E:
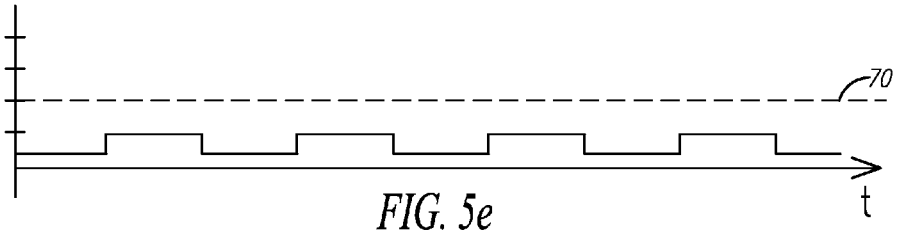

Referring now to FIG. 3, a vessel 60 for receiving dispensed water and/or ice is partially inserted into the recess 20. In this example, the vessel 60 is made of a material that prevents IR radiation from passing through it. Since the vessel 60 is only partially inserted, radiation 41 is still able to reach the second IR detector 23 while radiation 42 is blocked from reaching the first IR detector 22. Referring now to FIG. 4, the vessel 60 is now fully inserted into the recess 20. Since the vessel 60 is fully inserted into the recess 20, all radiation 43 is blocked from reaching both the first IR detector 22 and the second IR detector 23.

As described above, the control unit 50 sends a control signal to IR LED 21 and processes detection signals from the first IR detector 22 and the second IR detector 23. The control unit 50 includes a microprocessor programmed to perform signal control and processing functions. Further, the control unit 50 can perform additional operations, examples of which are described in further detail below, including sending a dispensing signal to the dispenser for dispensing water and/or ice, sending alert signals indicating a failed detection element, and adjusting a reference level.

Referring now to FIGS. 5(*a*)-5(*e*), wave diagrams are shown to illustrate the relationship between the IR LED emitter 21 waveform and IR detection waveforms under various conditions. FIG. 5(*a*) represents the output waveform for the IR LED emitter 21, which is modulated by the control unit 50 to produce a square wave with a given period. FIG. 5(*b*) represents an IR detection waveform during a period in which transmission and detection are not subject to any form of ambient light interference or disruption from vessel insertion.

FIGS. 5(*c*)-5(*e*) represent an IR detection waveform during a period of time when IR transmission is subject to ambient light interference. Natural and artificial ambient light can cause interference in IR transmission systems. Ambient light interference is detected by the IR detectors when the IR LED is off, causing the minimum amplitude of the detection waveform to increase during times when the IR LED is off. Thus, in comparison to FIG. 5(*b*), FIG. 5(*c*) is an IR detection waveform having a lower absolute amplitude ($V_{out\text{-}LEDon}$-$V_{out\text{-}LEDoff}$) due to ambient light interference. Since interference from ambient light is likely to occur in a home, a reference level 70 can be set so that the dispenser 16 will operate independent of ambient lighting conditions. If the control unit 50 is set to trigger the dispenser 16 only when the absolute amplitude of a waveform drops below the reference level 70, then ambient lighting conditions will not cause the dispenser to accidently dispense liquid or ice.

FIG. 5(*d*) represents an IR detection waveform during a period of time when a vessel 60 made from material that completely blocks radiation is inserted between the IR LED and the IR detector, thus blocking radiation from reaching the IR detector. Vessel 60 insertion causes the absolute amplitude of the waveform to drop below the reference level 70. Depending on ambient lighting conditions, ambient light interference may still be detected by the IR detector even though IR radiation from the IR LED is completely blocked by the vessel 60. However, not all vessels are made of material that will completely block IR radiation from reaching an IR detector. Some vessels will merely attenuate IR radiation, thus even when the vessel is fully inserted into the recess 20, the IR detector will detect an attenuated level of radiation emitted from the IR LED emitter 21. Factors that influence the amount of attenuation to IR radiation include vessel thickness, color and material. FIG. 5(*e*) represents a waveform during a period of time when an alternate vessel is fully inserted into the recess 20, where the alternate vessel is made of a material that merely attenuates the radiation, instead of completely blocking it. As seen in FIG. 5(*e*), the reference level 70 can be set to compensate for these conditions. Further, different reference levels can be individually set for each IR detector.

As may already be apparent, by the present vessel detector, the number of input/output lines running into the control device is reduced, thereby reducing manufacturing costs and operational time of the control software, and providing increased computational time for other software controlled operations. Further, it is possible to detect a failed emitter if both detector signals fall to zero at the same time. Similarly, a failed detecting element can be detected by determining an out of order arrival of any two signals detection signals to the input of the control unit. Any signal that is not received within an expected timeframe, or an out of order arrival of the detection signals can be used to detect the failure of one of the detectors. The invention also uses less power than a multiple emitter designs in that the majority of the power in the detection circuitry is used to power the emitting element of the design.

Figure 6:
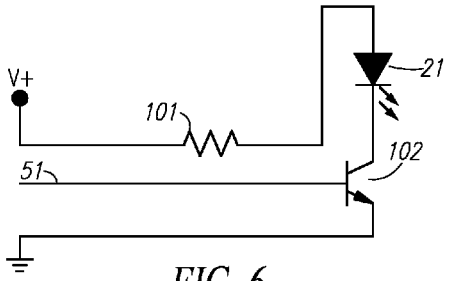
FIG. 6 shows a schematic view of an IR emitter circuit.

Referring now to FIG. 6, a schematic diagram of an IR emitter circuit is shown. A first resistor 101 is connected between a voltage source and an IR LED 21. The first resistor 101 is a current limiting resistor with an example resistance of 68 ohms. The IR LED 21 is connected to the collector terminal of a transistor 102. The control unit 50 is connected to the base terminal of the transistor 102 by connection 51.

Figure 7:
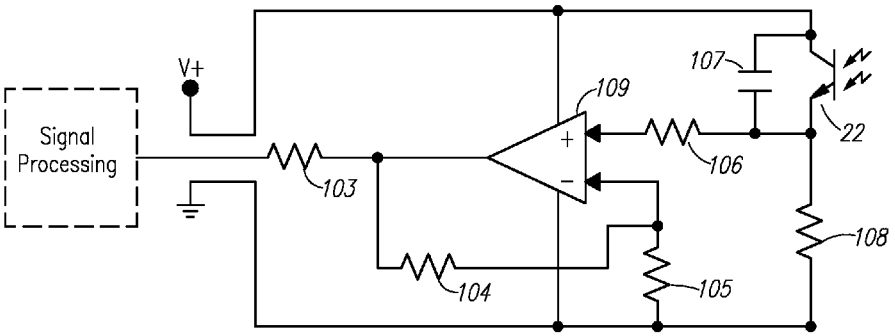
FIG. 7 shows a schematic view of a first IR detector circuit.

Referring now to FIG. 7, a schematic diagram of a first IR detection circuit is shown. A second resistor 103 having an example resistance of 2K ohms is connected between the output of a first amplifier 109 and a signal processing unit. First amplifier 109 is a JFET-input operational amplifier with a third resistor 104 having an example resistance of 9.1K ohms connected between the output and inverting input of amplifier 109, and a fourth resistor 105 having an example resistance of 1K ohms connected between the inverting input of first amplifier 109 and ground. The first IR detector 22 is a phototransistor with a first capacitor 107 having an example capacitance of 0.01 micro-farads connected between the collector and emitter. The capacitance value can be varied to provide suitable noise reduction without affecting the response time of the detecting element. A fifth resistor 106 having an example resistance of 1K ohms is connected between the non-inverting input of first amplifier 109 and the emitter of first IR detector 22. A sixth resistor 108 having an example resistance of 1K ohms is connected between the emitter of the first IR detector 22 and ground.

Figure 8:
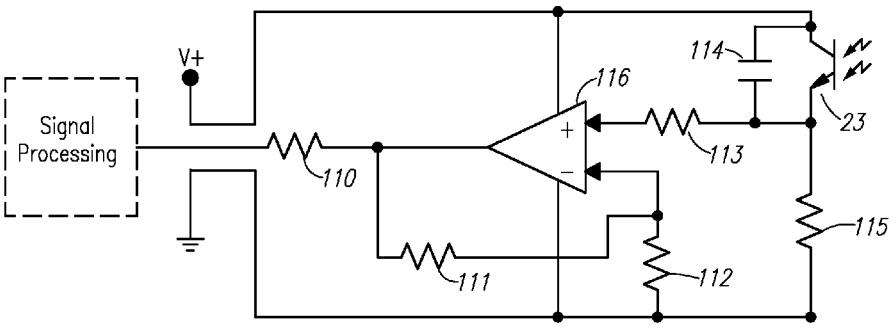
FIG. 8 shows a schematic view of a second IR detector circuit.

Referring now to FIG. 8, a schematic diagram of a second IR detection circuit is shown. A seventh resistor 110 having an example resistance of 2K ohms is connected between the output of a second amplifier 116 and a signal processing unit. Second amplifier 116 is a JFET-input operational amplifier with an eighth resistor 111 having an example resistance of 9.1K ohms connected between the output and inverting input of second amplifier 116, and a ninth resistor 112 having an example resistance of 1K ohms connected between the inverting input of second amplifier 116 and ground. The second IR detector 23 is a phototransistor with a second capacitor 114 having an example capacitance of 0.01 micro-farads connected between the collector and emitter. A tenth resistor 113 having an example resistance of 1K ohms is connected between the non-inverting input of second amplifier 116 and the emitter of second IR detector 23. An eleventh resistor 115 having an example resistance of 1K ohms is connected between the emitter of the second IR detector 23 and ground.

As explained above, the design makes use of an operational amplifier to amplify the input signal to the sensing device. By analyzing the operational amplifier output with an algorithm designed to allow for a slow change in amplitude, it is possible to adjust for changing input signals from the detector circuit due to component aging, lens degradation, ambient lighting changes, etc. This mechanism would allow the design to set either a higher or lower reference level and subsequently change the trigger level for the control unit to signal a dispense operation. This trigger level adaptation is accomplished by measuring the signal from the sensing elements thru the operational amplifier during a time when no object is sensed. The trigger level adjustment can be at for example a fixed time after a dispense operation, at some fixed time period to allow for ambient light changes, when no dispense operation has been seen for some period of time, or a combination of some decision making criteria. The maximum trigger level adjustment can be set to some percent of the previous trigger level. The use a filtering algorithm to slowly increase or decrease the trigger level would inhibit rapid sudden changes in the trigger level that would cause problems dispensing ice or water from the unit when a vessel is inserted.

Figure 9:
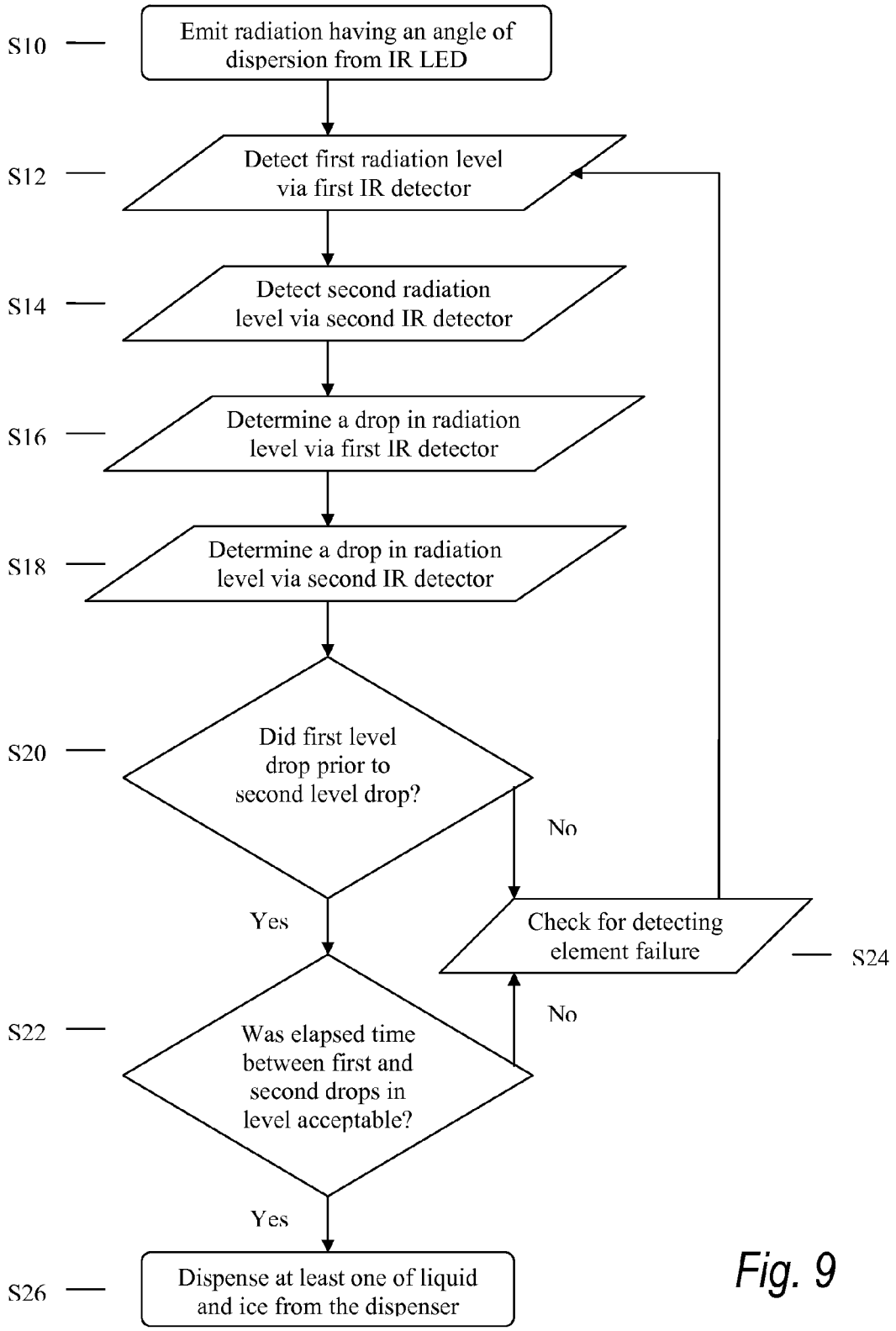
FIG. 9 shows a flow chart of a method for controlling a dispenser in a refrigeration appliance.

Referring now to FIG. 9, a flowchart for a method of monitoring a recess having a dispenser is shown. IR LED 21 emits radiation having an angle of dispersion (S10). A first IR detector 22 is arranged within a detectable area of the radiation and detects radiation levels (S12). A second IR detector 23 is also arranged within a detectable area of the radiation and detects radiation levels (S14). A first reduction in the level of radiation detected by the first detector is determined (S16), and a second reduction in the level of radiation detected by the second detector is determined (S18). Next, steps are taken to check for a failed detecting element. A determination is made as to whether the first reduction in radiation level occurred prior to the second reduction in radiation level (S20). Further, an elapsed time between the first and second reduction in radiation levels is determined (S22). Depending on a determination that the first reduction occurred prior to the second reduction, and that the elapsed time between reductions is acceptable, at least one of liquid and ice is dispensed from the dispenser (S26). If, however, it is determined that either the second reduction occurs prior to the first reduction, or that the elapsed time is not acceptable, an additional step is taken for determining a detecting element failure (S24). For instance, if the second reduction occurred prior to the first reduction, then the system may alert of a possible emitter failure. Or, if the elapsed time between the first and second drops in radiation levels was too short, then the system may alert of a possible detector failure. A minimum elapsed time may for example be determined by the off period of the waveform generated by the control unit.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A refrigeration appliance, comprising:

a cabinet forming an enclosure;

a dispenser that dispenses at least one of liquid and ice to an exterior of the enclosure; and a vessel detector including an infrared emitter, a first infrared detector, and a second infrared detector;

wherein the infrared emitter emits radiation having an angle of dispersion resulting in a conical area of radiation;

wherein the infrared emitter is pointed toward both the first and second infrared detectors and both of the first and second infrared detectors are arranged within the conical area of radiation and receive the radiation emitted by the infrared emitter;

wherein the first infrared detector is arranged closer to a front surface of the cabinet than the second infrared detector; and wherein the dispenser, the infrared emitter, and the first and second infrared detectors are arranged such that a vessel blocks the radiation from reaching both the first and second infrared detectors when said vessel is positioned to receive the at least one of liquid and ice from the dispenser.

2. The refrigeration appliance of claim 1 further comprising:

a control unit;

wherein the control unit controls a level of radiation emitted from the infrared emitter, and wherein the control unit receives a first detection signal from the first infrared detector and a second detection signal from the second infrared detector.

3. The refrigeration appliance of claim 2, wherein the control unit determines when at least one of a first level of radiation based on the first detection signal and a second level of radiation based on the second detection signal is less than a reference level.

4. The refrigeration appliance of claim 2, wherein the radiation emitted from the infrared emitter is modulated by the control unit to produce a square wave.

5. The refrigeration appliance of claim 2, wherein the control unit is configured to measure at least one of a first level of radiation and a second level of radiation through an amplifier circuit during a time when no vessel is detected.

6. The refrigeration appliance of claim 5, wherein the control unit is configured to adjust a reference level based on changes over time in at least one of the first level of radiation and the second level of radiation.

7. A refrigeration appliance, comprising:

a cabinet forming an enclosure;

a dispenser that dispenses at least one of liquid and ice to an exterior of the enclosure;

a vessel detector including an infrared emitter, a first infrared detector, and a second infrared detector; and a control unit;

wherein the infrared emitter emits radiation having an angle of dispersion resulting in a conical area of radiation;

wherein the infrared emitter is pointed toward both the first and second infrared detectors and both of the first and second infrared detectors are arranged within the conical area of radiation and receive the radiation emitted by the infrared emitter;

wherein the dispenser, the infrared emitter, and the first and second infrared detectors are arranged such that a vessel blocks the radiation from reaching both the first and second infrared detectors when said vessel is positioned to receive the at least one of liquid and ice from the dispenser; and wherein the control unit stores a minimum elapsed time;

detects a first reduction in a first level of radiation detected by the first infrared detector and a second reduction in a second level of radiation detected by the second infrared detector, determines an elapsed time between the first reduction and the second reduction, and sends a dispense signal to the dispenser based on the elapsed time being greater than the minimum elapsed time.

8. The refrigeration appliance of claim 7, wherein the control unit further determines if the first reduction is detected prior to the second reduction, and sends a dispense signal to the dispenser based on the first reduction being detected prior to the second reduction.

9. The refrigeration appliance of claim 1, wherein the second infrared detector is exposed to an opening of a recess formed in an exterior of the enclosure and the second infrared detector is arranged further back in the recess compared to the first infrared detector.

10. A refrigeration appliance, comprising:

a cabinet forming an enclosure;

a dispenser that dispenses at least one of liquid and ice to an exterior of the enclosure; and a vessel detector including a single infrared emitter, a first infrared detector, and a second infrared detector;

wherein the single infrared emitter emits radiation having an angle of dispersion resulting in a conical area of radiation;

wherein the single infrared emitter is pointed toward both the first and second infrared detectors and both of the first and second infrared detectors are arranged within the conical area of radiation and receive the radiation emitted by the single infrared emitter;

wherein the first infrared detector is arranged closer to a front surface of the cabinet than the second infrared detector, and wherein the dispenser, the single infrared emitter, and the first and second infrared detectors are arranged such that a vessel blocks the radiation from reaching both the first and second infrared detectors when said vessel is positioned to receive the at least one of liquid and ice from the dispenser.

* * * * *